United States Patent [19]

Hoover

[11] 4,236,278

[45] Dec. 2, 1980

[54] PLANETARY COILER ESPECIALLY USEFUL FOR COILING TEXTILE STRAND MATERIAL

[76] Inventor: Donald L. Hoover, 4428 Coachwood La., Gastonia, N.C. 28052

[21] Appl. No.: 949,501

[22] Filed: Oct. 10, 1978

[51] Int. Cl.[3] ..... B65H 54/80

[52] U.S. Cl. ..... 19/159 R

[58] Field of Search ..... 19/157, 159 R, 159 A; 28/289; 242/82, 83

[56] References Cited

U.S. PATENT DOCUMENTS

| | | | |
|---|---|---|---|
| 2,719,338 | 10/1955 | Carmichael | 19/159 R |
| 3,345,701 | 10/1967 | Eichenberger et al. | 19/159 R |
| 3,345,703 | 10/1967 | Varga | 19/159 R |
| 3,355,775 | 12/1967 | Whitehurst | 19/159 R |
| 3,387,340 | 6/1968 | Caldwell et al. | 19/159 R |
| 3,470,587 | 10/1969 | Kincaid | 19/159 R |
| 3,562,864 | 2/1971 | Osgood et al. | 19/159 R |

*Primary Examiner*—Louis Rimrodt

*Attorney, Agent, or Firm*—Bell, Seltzer, Park & Gibson

[57] ABSTRACT

A planetary coiler for strand material includes a circular rotary stabilizing member in which a coiler member is eccentrically positioned for rotation therein, and drive arrangements are connected to the coiler member for imparting rotation thereto and for moving the same in an orbital path of travel so that the coiler member transmits rotation to the stabilizing plate member by virtue of the orbital path of movement of the coiler member.

14 Claims, 6 Drawing Figures

PLANETARY COILER ESPECIALLY USEFUL FOR COILING TEXTILE STRAND MATERIAL

FIELD OF THE INVENTION

This invention generally relates to the art of coiling strand material, e.g., fibrous textile sliver, into circular containers or cans, and more especially, to an improved planetary coiler for performing such coiling of strand material.

BACKGROUND OF THE INVENTION

Generally a planetary coiler is characterized by having a rotary, circular, stabilizing plate member provided with an eccentric opening therein within which a rotary coiler member is positioned for rotation therein. Typical planetary coilers of this type are disclosed in various prior art United States patents, such as Carmichael et al U.S. Pat. No. 2,719,338, Varga U.S. Pat. No. 3,345,703, Whitehurst U.S. Pat. No. 3,355,775 and Caldwell et al U.S. Pat. No. 3,387,340, for example. However, there are various drawbacks in known prior art planetary coilers, among which is the substantial weight and consequent inertia of the rotary stabilizing plate member and the coiler member being such as to require substantial energy in order to rotate such members relative to each other. Accordingly, it has been the more general practice heretofore to provide a large and relatively heavy and expensive ring gear of about the same diameter as, and positioned axially of, the stabilizing plate member, or to provide the periphery of the stabilizing plate member with gear teeth therearound, for engagement by a driven pinion for rotating the stabilizing plate member, along with other gearing cooperating with the driven pinion for rotating the coiler member and moving the same in an orbital path, generally as disclosed in the aforementioned Carmichael et al, Varga and Whitehurst patents.

As an alternative to the use of gears or gear teeth around the stabilizing plate member of a planetary coiler, an arrangement of grooved pulleys and endless pliable belts has been proposed, such as that disclosed in the aforementioned Caldwell et al patent. Such pulleys are quite large and heavy and are supported upon the coiler member; i.e., the larger of the pulleys is of about the same diameter as the coiler member, with the weight of the coiler member and its pulleys being supported upon the rotary stabilizing plate member.

BRIEF SUMMARY OF THE INVENTION

With the foregoing in mind, it is an object of this invention to provide an improved planetary coiler which overcomes the above and other deficiencies of known prior art planetary coilers and is relatively inexpensive of manufacture as compared to such known prior art planetary coilers.

Another object is to provide a planetary coiler which produces only minimal noise in its operation as compared to known prior art planetary coilers.

In accordance with the broad aspect of this invention, the improved planetary coiler includes a circular rotary stabilizing plate member having a fixed rotational axis, with a rotary coiler member rotatable in the plate member in eccentric relation thereto, and wherein means is operably connected to the coiler member for imparting rotation thereto and for moving the same in an orbital path substantially concentric with the axis of the stabilizing plate member so that the rotary coiler member transmits rotation to the stabilizing plate member upon orbital movement of the coiler member.

BRIEF DESCRIPTION OF THE DRAWINGS

Some of the objects and advantages of the invention having been stated, others will appear as the description proceeds when taken in connection with the accompanying drawings, in which.

DETAILED DESCRIPTION

The present invention will be described hereinafter with particular reference to the accompanying drawings which show a preferred embodiment of the present invention. It is to be understood at the outset, however, that the drawings and description are for illustrative purposes and are to be construed broadly, since it is contemplated that variations in detail may be made in practicing the invention. With this in mind, there will be observed in FIG. 1 a dual or two-delivery planetary coiler, including two side-by-side, first and second, planetary coiler heads A, A′, illustrative of a preferred embodiment of the invention.

Figure 1:
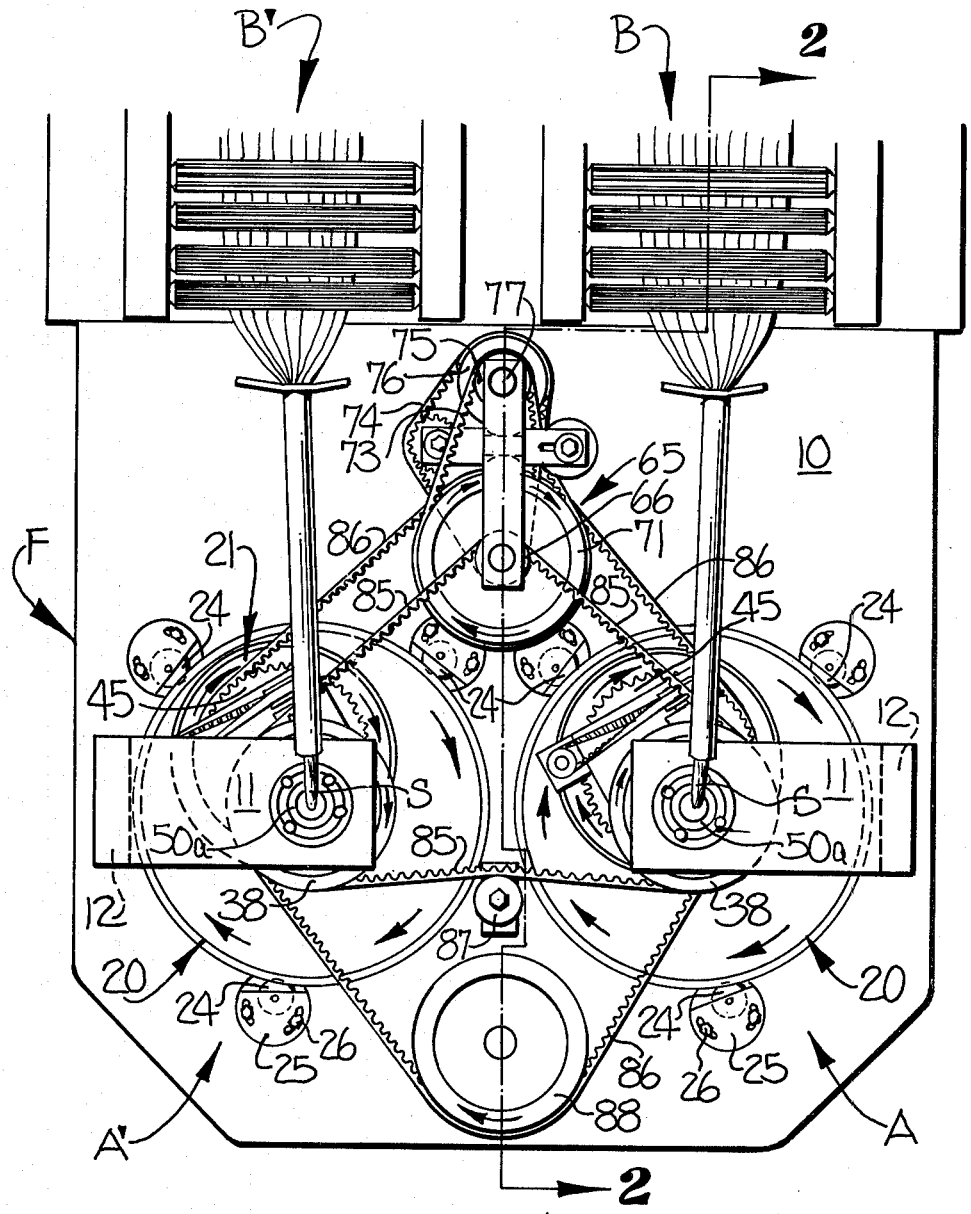
FIG. 1 is a top plan view of a preferred embodiment of the invention shown in the form of a dual planetary coiler in association with a strand forming machine exemplified as a dual or two-delivery drawing frame for textile fibers.
Figure 2:
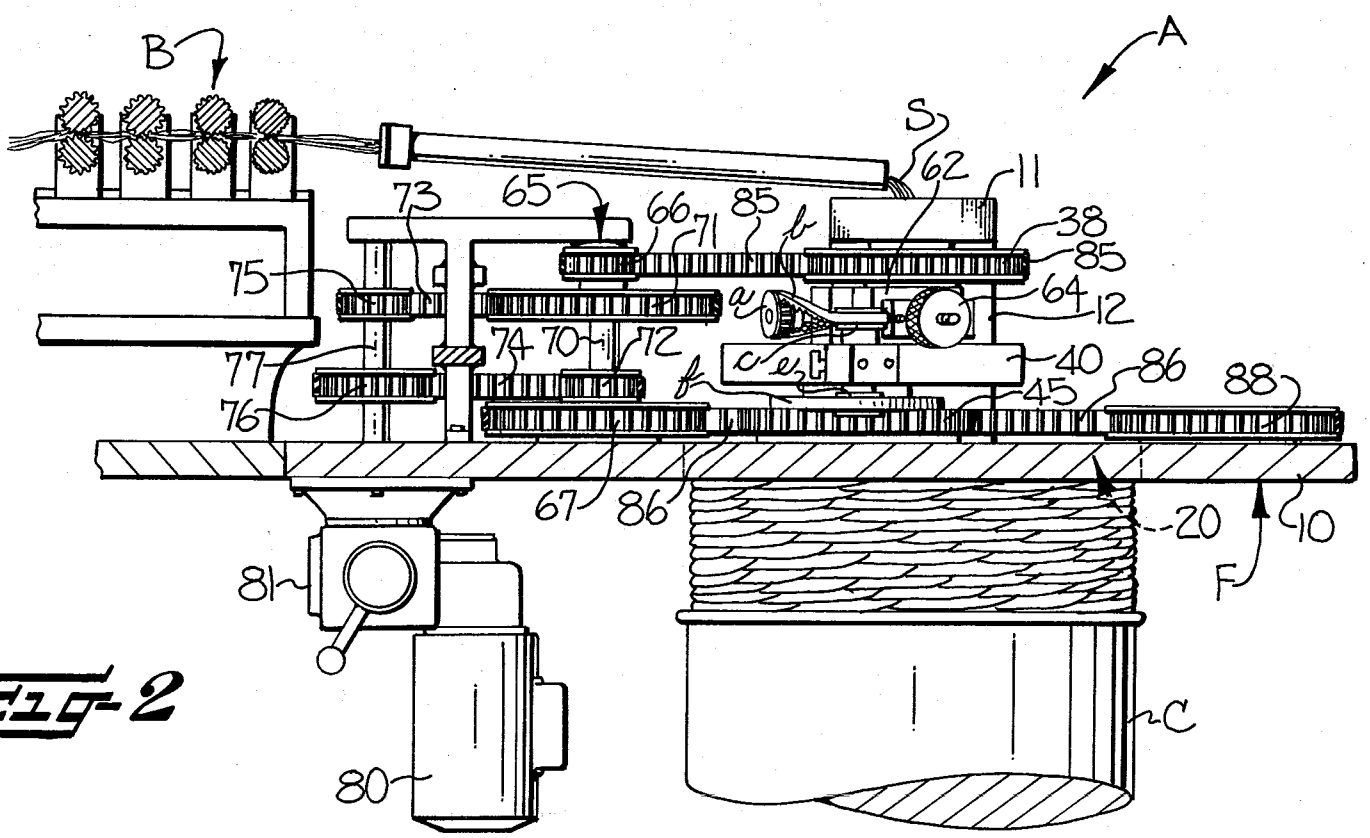
FIG. 2 is an enlarged side elevation of the first or right-hand planetary coiler head of FIG. 1, partially in section, and being taken substantially along the line 2—2 in FIG. 1.

The coiler heads A, A′ are arranged for receiving strand material, such as fibrous textile slivers S, from two respective strand producing units B, B′ (FIG. 1) and for coiling such strand material into respective upright containers or cans C, only one of which is shown in FIG. 2. The strand producing units may take the form of roller drawing units, gill boxes, pin drafters or the like, or they may take various other forms well known in the applicable arts. Therefore, a detailed description of the strand producing units is deemed unnecessary.

The planetary coiler heads A, A′ and related driving mechanisms are carried by a frame F which may be separate from or attached to the frame of the strand producing units B, B′, and which is shown as comprising a stationary substantially horizontal platform or support plate 10, generally known as a stationary spectacle plate in the applicable textile arts, and which supports thereon both coiler heads A, A′ and extends over corresponding coiler cans C. In this instance, the frame F further comprises a portion 11 which largely overlies each respective coiler head A, A' and which constitutes the substantially horizontal upper portion or arm of a respective inverted substantially L-shaped bracket means 12 suitably secured to and extending upwardly from the stationary support plate 10.

With the exception of drive means being common to both planetary coiler heads A, A', the coiler heads may be considered as separate, substantially identical entities. Therefore, only the first planetary coiler head A will be described in detail hereinafter, and where applicable, those parts of the second coiler head A which correspond to similar parts of the first coiler head A will bear the same reference characters to avoid repetitive description. It is also to be understood that, although components of the coiler head will be described hereinafter as occupying certain vertical or horizontal positions, it is apparent that these terms are used to simplify the description, since the axes of rotary components of a coiler may occupy other angular positions as manifested by available prior art patents relating to strand coiling systems.

Figure 3:
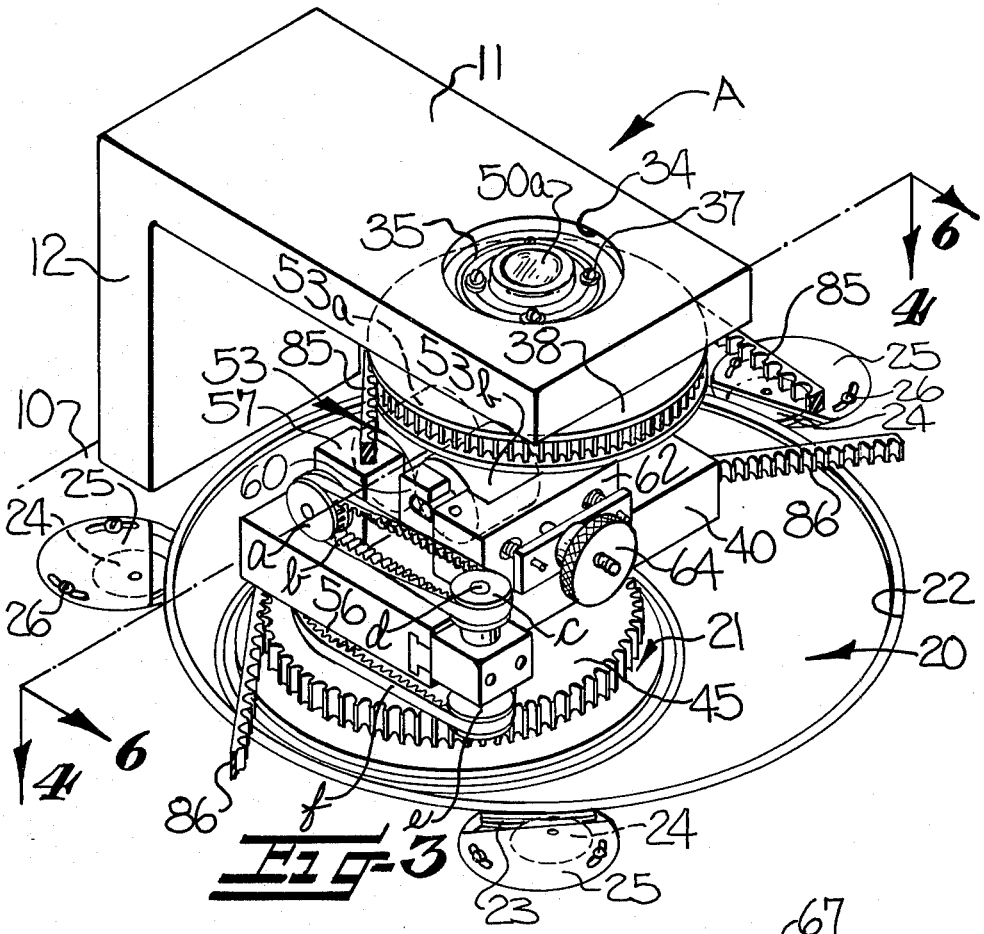
FIG. 3 is a further enlarged fragmentary perspective view of the coiler head looking downwardly from the upper left-hand portion of FIG. 2.
Figure 6:
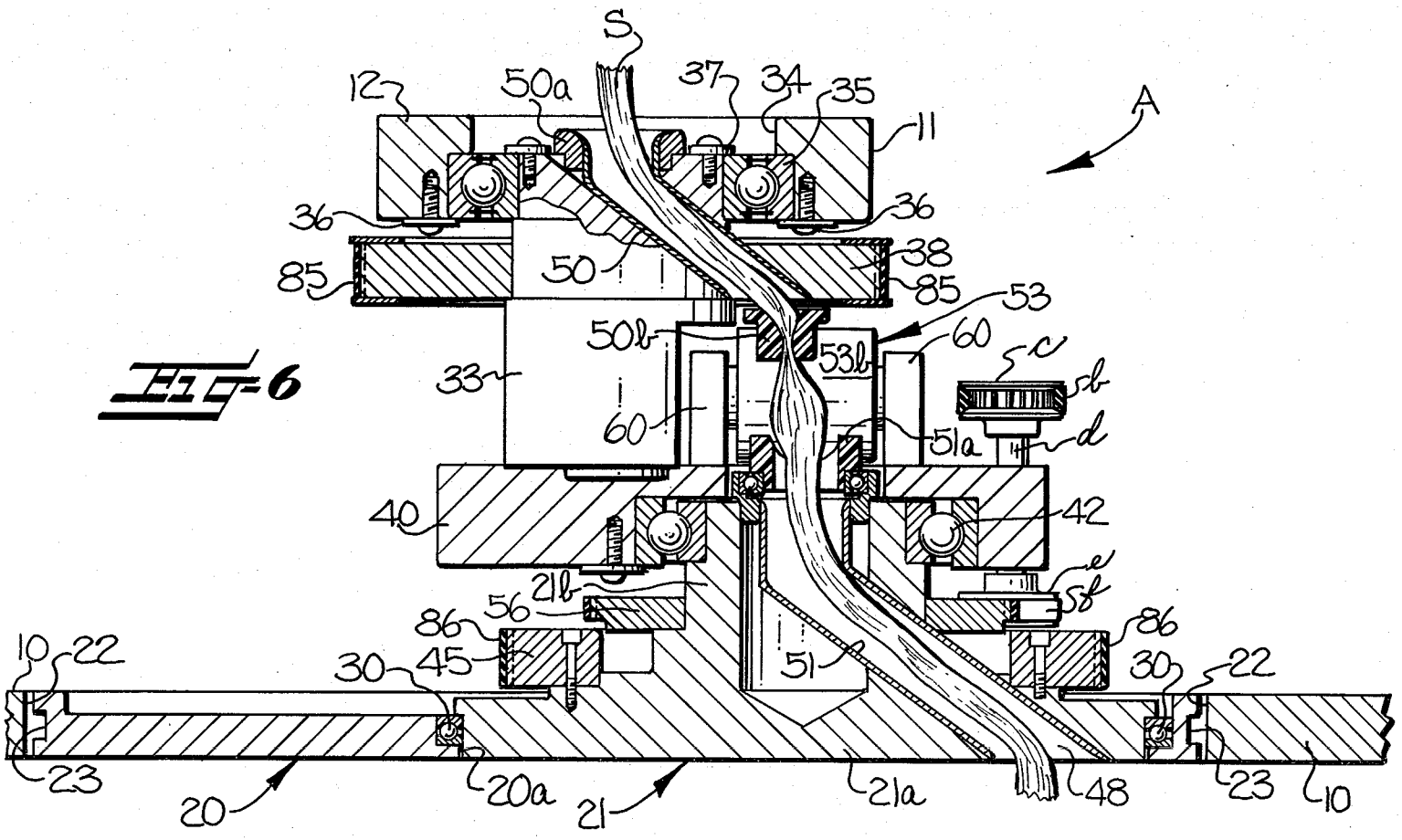
FIG. 6 is an enlarged vertical sectional view through the coiler head looking substantially along the line 6—6 of FIG. 3.

Referring now to FIGS. 2, 3, and 6, where details of the first planetary coiler head A are best illustrated, it can be seen that the planetary coiler head A comprises a rotary, circular stabilizing plate member 20; sometimes called a rotary spectacle plate in the textile industry, which has a fixed rotational axis and has a rotary coiler member 21 rotatable in a suitable opening 20*a* in the plate member 20 (FIG. 6) located in eccentric relation to plate member 20. As will be later described, means is operably connected to coiler member 21 for imparting rotation thereto and for moving the same in an orbital path substantially concentric with the axis of stabilizing plate member 20 so that coiler member 21 transmits rotation to stabilizing plate member 20 upon orbital movement of said coiler member 21 about said fixed axis. In order that the planar lower surfaces of the rotary stabilizing plate member, the rotary coiler member 21 and the stationary platform 10 may be substantially flush with each other, platform 10 has a circular opening 22 therethrough in which the stabilizing plate member 20 is loosely positioned in substantially concentric relation thereto.

Means are provided for supporting the rotary stabilizing plate member 20 for rotation in the circular opening 22 in platform 20. Accordingly, the peripheral surface of stabilizing plate member 20 is provided with a peripheral groove 23 (FIG. 6) therein engaged by a plurality of circularly spaced supporting rollers 24 (FIGS. 1 and 3) which may be in the form of antifriction bearings, as is preferred. Each of the rollers 24 is positioned within a suitable recess provided in the upper surface of platform 10 and is journaled in eccentric relation to a carrier disc 25 adjustable about its own axis, as by screws 26, for adjusting the corresponding roller 24 inwardly and outwardly with respect to the axis of the rotary stabilizing plate member 20. The screws 26 extend through adjustment slots in discs 25 and may be threaded into platform 10 so that the rollers 24 may be readily adjusted to maintain the rotary stabilizing plate member 20 in the desired concentric relation to the opening 22 in platform 10. In this regard, it is apparent that the upper wall of groove 23 in rotary stabilizing plate member 20 bears upon the supporting rollers 24 for supporting stabilizing plate member 20 with its bottom surface in substantially flush relation to the lower surface of platform 10.

A suitable annular bearing means 30, shown in the form of an antifriction bearing in FIG. 6, surrounds the periphery of the lower circular portion or body 21*a* of coiler member 21 for rotatably positioning the same in the eccentric opening 20*a* provided in stabilizing plate member 20 and thereby insuring that the lower surface of coiler member 21 may be substantially flush with the lower surface of stabilizing plate member 20, as is preferred.

In order to support and thereby aid in imparting rotation to coiler member 21 about its own substantially vertical axis and to also facilitate movement of coiler member 21 in an orbital path, the aforementioned overlying portion 11 of bracket means 12 has the upper portion of a shaft means 33 rotatably mounted therein in substantially axially spaced relation from stabilizing plate member 20. In this instance, shaft means 33 is rotatably supported by the overlying portion 11 of bracket means 12 and in suspended relation thereto. To this end, it will be observed in FIG. 6 that bracket portion 11 is provided with an opening 34 in which an annular antifriction bearing means 35 is positioned, with the outer race of the bearing means 35 being supported on washers or projecting members 36 suitably secured to the lower surface of bracket portion 11, and with the upper portion of shaft means 33 being secured to the inner race of antifriction bearing means 35 by similar projecting members 37 suitably secured to the upper surface of and projecting outwardly from the upper end of shaft means 33. The upper portion of shaft means 33, below and closely adjacent the overlying portion 11 of bracket means 12, has an inboard first wheel means 38 fixedly mounted thereon in axial relation thereto for aiding in imparting rotation to shaft means 33 in a manner to be more fully described hereinafter.

A reduced, stepped, upper portion or hub portion 21*b* of rotary coiler member 21 is rotatably connected to a lower portion of shaft means 33 in eccentric relation thereto so that rotation of shaft means 33 imparts orbital movement to rotary coiler member 21. To this end, the lower portion of shaft means 33 has a crank means or arm 40 fixed thereon and projecting radially outwardly therefrom and in which the reduced upper portion 21*b* of the rotary coiler member 21 is suspendingly rotatably mounted as by means of a suitable antifriction bearing means 42 (FIG. 6). It is apparent that the outer race of bearing means 42 may be pressed into a suitable cavity provided in the bottom of the crank means 40, and the inner race of bearing means 42 may be pressed onto the upper end portion 21*b* of coiler member 21, or bearing means 42 may be secured to hub 21*b* and arm 40 in substantially the same manner as that in which bearing means 35 is secured to bracket 12 and shaft means 33.

From the foregoing description of the antifriction bearing means 24 (FIG. 3), 30 (FIG. 6), 35 and 42 and the related elements of the planetary coiler head A, it can be appreciated that the rotary stabilizing plate member 20, rotary coiler member 21 and shaft means 33 may be easily rotated. Stated otherwise, it is to be noted that virtually all the weight of rotary coiler member 21, crank means 40, shaft means 33 and elements carried thereby is borne by bracket means 12. This in turn ensures that the rotary stabilizing plate member 20 need not support the rotary coiler member 21 and those elements shown thereabove in FIGS. 2, 3 and 6, and results in substantially less inertia being present in the rotary stabilizing member 20 and the rotary coiler member 21 than has been the case in known planetary coilers heretofore. Consequently, the endless pliable elements 85, 86, which drive shaft means 33 and coiler member 21 in a manner to be later described, may be of relatively light material, such as rubber or rubber-like plastic, and the motive means 80 (FIG. 2), such as an electric motor, may be of relatively low horse power.

Suitably secured to and encircling the upwardly projecting hub portion 21*b* of rotary coiler member 21 is an inboard second wheel means 45 positioned closely above the level of the rotary stabilizing plate member 20. The inboard second wheel means 45 is instrumental in imparting rotation to the rotary coiler member 21 about its own axis during the orbital movement thereof as will be more fully described hereinafter.

Means is provided for successively guiding the corresponding strand material S into and through the shaft means 33 and through the coiler member 21 in a generally angular and generally radial path to an eccentric exit opening 48 (FIG. 6) provided in the bottom of rotary coiler member 21 for egress of the strand material S therethrough during operation of the planetary coiler head. Such guiding means may take the form of tubular guide members 50, 51 defining respective strand guiding passages in the shaft means 33 and in the coiler member 21. The tubular guide members 50, 51 have their proximal ends spaced from each other and they cooperate with intervening driven feed roll means 53 rotatably mounted on that portion of crank means 40 in which the upper portion 21*b* of coiler member 21 is journaled.

As shown in FIG. 6, the open upper end of the upper tubular guide member 50 defines the inner wall of a strand ingress trumpet 50*a*, and the tubular guide member 50 extends downwardly and radially outwardly through the shaft means 33 and then through the adjacent portion of the inboard first wheel means 38. The tubular member 50 terminates at its lower end substantially flush with the bottom surface of the inboard first wheel means 38. From the open lower end of the upper tubular member 50, the strand material S passes through a suitable trumpet means 50*b* for guiding the strand material S into the nip of the rolls 53*a*, 53*b* of feed roll means 53, from whence the feed roll means 53 directs the strand material S into the open upper end of the lower tubular guide member 51, it being noted that the open upper end of lower tubular guide member 51 communicates with a guide sleeve or trumpet 51*a* whose lower portion is suitably journaled on the upper end of rotary coiler member 21 and whose upper portion is positioned between the adjacent lower portions of the rolls of feed roll means 53. Thus, it can be appreciated that coiler member 21 may rotate about its substantially vertical axis relative to the guide sleeve 51*a* as the strand material S is being fed thereinto by the feed roll means 53 and is thus fed downwardly and outwardly through the passage defined by the lower tubular member 51 and outwardly through the exit opening 48 in the rotary coiler member 21.

Figure 4:
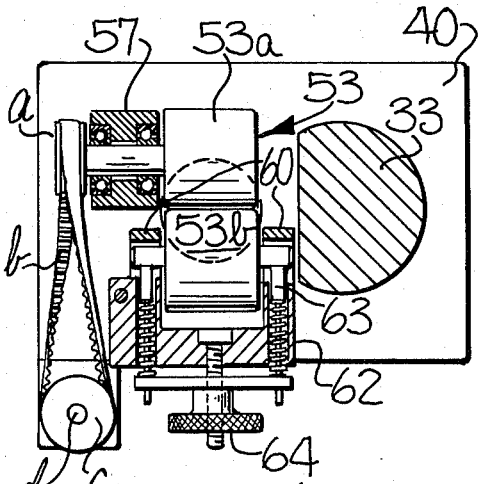
FIG. 4 is an enlarged fragmentary sectional plan view taken substantially along line 4—4 in FIG. 3.

The feed roll means 53 may be suitably supported on the crank means 40 so as to be driven from an inboard third wheel means 56 (FIGS. 3 and 6) fixedly mounted on the hub or reduced upper portion 21*b* of rotary coiler member 21 and being positioned between the inboard second wheel means 45 and the crank means 40 (FIG. 6). Accordingly, as best shown in FIG. 4, it will be observed that the reduced end or shaft of roll 53*a* is journaled in a bearing stand 57 suitably secured upon crank means 40, and the outer end portion of the latter shaft has a pulley a fixed thereon connected by a partially twisted endless pliable element b to a pulley c mounted on the upper end of a substantially vertically disposed shaft d journaled in crank means 40. As best shown in FIGS. 3 and 6, the lower end portion of shaft d, below the crank means 40, has a pulley 3 fixed thereon which is engaged by an endless pliable element f entrained about the inboard third wheel means 56.

To ensure that there may be a precise predetermined relationship between the rate of rotation of strand exit opening 48 (FIG. 6) about the axis of coiler member 21 and the peripheral speed of feed rolls 53*a*, 53*b*, it is preferred that pulleys a, c, e and the inboard third wheel means 56 have peripheral projecting teeth therearound and that each of the endless pliable elements b, f is in the form of a flexible endless belt having teeth therealong meshing with the teeth of the corresponding pulleys and wheel means, such flexible endless belts being known generally as "timing belts". It is apparent that such teeth prevent slippage of the belts relative to the pulleys a, c, e and the wheel means 56.

Referring again to FIG. 4, it will be observed that the reduced end portion or shaft of feed roll 53*b* is positioned in spaced slotted bearings 60 or bifurcations of a bracket means 62 suitably secured upon crank means 40. Bracket means 62 has a pair of spring-loaded plungers 63 therein whose pressure against the shaft of feed roll 53*b* is adjustable by means of a screw type of adjustment mechanism 64 serving to maintain the feed roll 53*b* in pressure engagement with feed roll 53*a* for feeding the strand material S therebetween. Since the manner of resiliently loading a feed roll is well known in the textile and other arts, a further description of the resilient loading means 63 for the feed roll 53*b* is deemed unnecessary.

As heretofore indicated, driving means is operably connected to coiler member 21 for imparting rotation thereto and for moving the same in an orbital path substantially concentric with the fixed axis of stabilizing plate member 20 so that the coiler member 21 transmits rotation to the stabilizing plate member 20 upon orbital movement of the coiler member 21 about said fixed axis. The inboard first and second wheel means 38, 45 being fixedly mounted on shaft means 33 and coiler member 21, respectively, in axial relation thereto, are elements of such driving means. Additionally, drive means is operably connected to the shaft means 33 and coiler members 21, 21 of both coiler heads A, A′ (FIGS. 1 and 5), via the corresponding first and second wheel means 38, 45 for rotating both of the shafts 33 and both of the coiler members 21 about their respective axes. Accordingly, driven additional wheel means, broadly designated at 65 (FIGS. 1 and 2) is spaced generally radially outwardly from the shaft means 33 sufficiently to avoid interference thereof with the orbital movement of both coiler members 21 about the axes of the respective shaft means 33 incidental to rotation of the shaft means, and endless pliable elements common to both coiler heads A, A′ extend between and drivingly connect the additional wheel means to the first and second wheel means 38, 45 (FIG. 6) for driving the same.

Accordingly, it will be observed in FIGS. 1 and 2 that the last-mentioned driven additional wheel means 65 comprises outboard first and second wheel means 66, 67 shown located entirely outwardly of the vertical planes of the stabilizing plate members of the coiler heads A, A′ and being located rearwardly of and about halfway between coiler heads A, A′.

In the present embodiment of the invention, since it is preferred that the outboard wheel means 66, 67 are driven at different speeds about a common axis, they may be rotatably mounted on a common substantially vertically disposed jack shaft 70 (FIG. 2) carried by the frame F. Pulleys or wheel means 71, 72 are also mounted on shaft 70 in fixed axial relation to the respective outboard wheel means 66, 67 and are connected by respective endless pliable elements 73, 74 to respective driving pulleys or wheel means 75, 76 fixed on a common substantially vertically disposed drive shaft 77. As shown in FIG. 2, drive shaft 77 may be driven by the motive means 80 suitably secured to and suspended from platform 10. A suitable speed variator or variable speed transmission 81 may be interposed between motive means 80 and drive shaft 77 for synchronizing the speed of rotary stabilizing plate members 20 and the rotary coiler members 21 of coiler heads A, A' FIG. 1) with the rate of production of the strand material S issuing from the strand producing units B, B'.

Heretofore, the stabilizing plate members or rotary spectacle plates of known prior art planetary coilers have largely been in the form of gears of relatively large diameter having peripheral teeth thereon for engagement by a driven pinion for rotating the stabilizing plate members. In some instances, large ring gears have been secured in axial relation to the stabilizing plate members or rotary spectacle plates of known prior art planetary coilers instead of providing gear teeth on the peripheries of the stabilizing plate members for effecting rotation of the same. As is well-known the manufacture of such large gears, which may be up to thirty six inches or more in diameter, is quite expensive.

Figure 5:
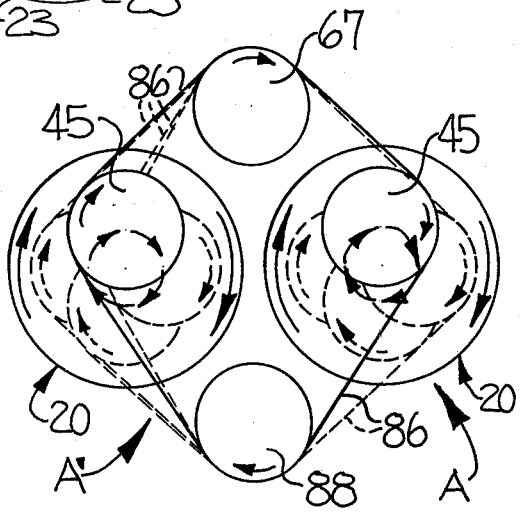
FIG. 5 is a schematic plan view of the coiler heads shown in FIG. 1 and particularly illustrating different paths traced by an endless pliable element which imparts rotation to the coiler members of the two coiler heads during their orbital travel about the axes of respective rotary stabilizing plate members or spectacle plates.

Therefore, in order to eliminate the need for such large diameter gears, as well as to reduce the noise of operation of the planetary coiler heads, the inboard first and second wheel means 38, 38; 45, 45 of the two coiler heads A, A' are engaged by the respective endless pliable elements 85, 86 which, as best shown in FIGS. 1 and 5, are common to both coiler heads A, A'. In this regard, it will be observed in FIGS. 1 and 2 that the endless pliable element 85 is positioned above pliable element 86 and extends forwardly from the outboard first wheel means 66 and over the rotary stabilizing plate member 20 of coiler head A, and then partially around and in engagement with the periphery of the inboard first wheel means 38 of the first coiler head A. From the latter inboard first wheel means 38, the endless pliable element 85 extends laterally to the inboard first wheel means 38 of the second coiler head A'. The endless pliable element 85 then passes partially around the latter inboard first wheel means 38 and thence back to the outboard first wheel means 66 to complete the path or circuit of the upper or first endless pliable element 85. A suitable idler wheel or pulley 87 (FIG. 1) may be provided between the two inboard first wheel means 38, 38 for engaging and maintaining taut the corresponding run of endless pliable element 85. The idler wheel or pulley 87 may be suitably rotatably supported upon the stationary platform 10 as shown in FIG. 1.

The lower or second endless pliable element 86 is entrained about the outboard second wheel means 67 (FIGS. 2 and 5) and the inboard second wheel means 45, 45 of both coiler heads A, A' in a manner somewhat similar to that in which the upper or first pliable element 85 is entrained about the wheel means 66 and 38, 38 of the two coiler heads A, A'. However, since both of the inboard second wheel means 45, 45 move in respective orbital paths about the axes of the respective stabilizing plate members 20, 20 during rotation of the two inboard second wheel means 45, 45 the two reaches or runs of the second endless pliable element 86 forwardly of the two inboard second wheel means 45, 45 extend forwardly in converging relation to each other where the endless pliable element 86 extends partially around and in engagement with the periphery of an idler pulley or wheel means 88 suitably rotatably supported upon the stationary platform 10. It will be noted that due to the orbital paths of the two inboard second wheel means 45, 45, the angular positional relationship between the various reaches of the second endless pliable element 86 engaging the same, progressively changes during each successive orbital movement of each inboard second wheel means 45, 45. This is best illustrated in FIG. 5. Therefore, it has been found desirable to maintain a constant relationship between the orbital angular positions of the two second wheel means 45, 45 as well as between the relative angular positions of the two second wheel means 45, 45 about their own axes. It is to be noted that it is desirable for the rotary coiler members 21, 21 to occupy substantially the same relative angular positions in their orbital movements about the axes of the respective rotary stabilizing plate members 20, 20 at any given instant so as to maintain the endless pliable element 86 in engagement with wheel means 45, 45, 67, 88 and under substantially uniform tension throughout each orbit of each rotary coiler member 21.

As is preferred, and in further accord with the present invention, in order to obtain a predetermined rotational angular relationship between the two inboard first wheel means 38, 38, which effect the orbital movement of the two rotary coiler members 21, and the respective inboard second wheel means 45, 45 and to also maintain a predetermined angular rotational relationship between the two rotary coiler members 21, 21 and the inboard second wheel means 45, 45 which rotate the same about their own axes, it is preferred that each of the first and second endless pliable elements 85, 86 is in the form of a flexible endless belt having teeth therealong meshing with teeth on the peripheries of the corresponding wheel means 38, 38, 45, 45, 66, 67 (FIGS. 2 and 3) being engaged thereby. Further, it is preferred that the idler wheel means 88 (FIG. 1) is provided with peripheral teeth thereon meshing with the teeth of the corresponding endless pliable element 86.

To further aid in maintaining the desired angular relationship between the rotational positions of the two rotary coiler members 21, 21 about their respective axes, it has been found desirable to space the axes of the two wheel means 67, 88 substantially equal distances apart from the axes of the respective rotary stabilizing plate members 20, 20. In other words, it is preferred that the distance from an imaginary straight line, extending between the axes of the two rotary stabilizing plate members 20, 20 in FIG. 1, to the axes of the two wheel means 67, 88 is substantially equal, with the two wheel means 67, 88 being of substantially the same effective diameter. In effect, since it is apparent that the teeth in the inner faces of the endless pliable elements 85, 86 should be of the same pitch relationship, there may be essentially the same number of teeth in each reach of the upper endless pliable element 85 extending between the points of tangency of the outboard first wheel means 66 and each respective inboard first wheel means 38. Also, there may be a constant number of teeth in the two runs of the endless pliable element 86 which extend between the points of tangency of the two inboard lower or second wheel means 45, 45 rearwardly thereof. It is apparent that the term "points of tangency" is used to mean that point on the surface of a wheel means at which a corresponding run of the particular pliable element extends away from the periphery of the corresponding wheel means.

From the foregoing description, it can be seen that each planetary coiler head A, A' comprises a rotary stabilizing plate member 20 having a fixed rotational axis, with a rotary coiler member 21 rotatable in the respective stabilizing plate member 20 in eccentric relation thereto and wherein means are provided which is operably connected to the coiler members 21 for imparting rotation thereto and for moving the same in respective orbital paths substantially concentric with the axes of the respective rotary stabilizing plate members 20 so that the coiler members 21 transmit rotation to the respective stabilizing plate members 20 upon orbital movement of the respective coiler members 21 about the respective fixed axes of the plate members 20.

In the drawings and specification there has been set forth a preferred embodiment of the invention, and although specific terms are employed, they are used in a generic and descriptive sense only and not for purposes of limitation.

That which is claimed is:

1. A planetary coiler for strand material comprising a stabilizing plate member mounted for rotation about a fixed axis, a coiler member rotatable about a predetermined axis in eccentric relation to said fixed axis of said stabilizing plate member, means operably connected to said coiler member for imparting rotation thereto about said predetermined axis and for moving said coiler member in an orbital path substantially concentric with said axis of said stabilizing plate member, and means mounting said coiler member in driving relation to said stabilizing plate member so that said coiler member drives said stabilizing plate member in rotation upon orbital movement of said coiler member about said axis of said stabilizing plate member.

2. A planetary coiler for strand material comprising a stabilizing plate member having a fixed rotational axis, a coiler member rotatable in said plate member in eccentric relation thereto, means operably connected to said coiler member for imparting rotation thereto and for moving the same in an orbital path substantially concentric with the axis of said plate member, and means mounting said coiler member in driving relation to said stabilizing plate member so that said coiler member transmits rotation to said stabilizing plate member upon orbital movement of said coiler member about said axis of said stabilizing plate members.

3. A planetary coiler according to claim 2 wherein said means operably connected to said coiler member for imparting rotation thereto and moving the same in an orbital path includes shaft means rotatably mounted in substantially axially spaced relation from said stabilizing plate member, means for driving said shaft means, and means rotatably mounting said rotary coiler member to said shaft means in eccentric relation thereto for moving said coiler member in said orbital path upon rotation of said shaft means to in turn transmit rotation to said rotary stabilizing plate member.

4. A planetary coiler according to claim 3 wherein said means rotatably mounting said coiler member to said shaft means includes a laterally extending crank means carried by said shaft means and in which a portion of said coiler member is journaled, and further comprising feed roll means mounted on said crank means, means cooperating with said driving means for also driving said feed roll means, and means defining respective strand guiding passages in said shaft means and said coiler member for guiding strand material through said shaft means to said feed roll means and for guiding the strand material from said feed roll means through said coiler member as the strand material is being fed by said feed roll means.

5. A planetary coiler according to claim 3 wherein said coiler member is provided with an eccentric exit opening therein remote from said shaft means for egress of strand material therethrough during operation of the planetary coiler, and means for guiding the strand material into and through said shaft means and said coiler member in a generally angular and generally radial path to said exit opening.

6. A planetary coiler according to claim 5 including feed roll means interposed in said guide means and located between said shaft means and said coiler member for feeding the strand material along said path through said shaft means and said coiler member.

7. A planetary coiler according to claim 2 wherein said means operably connected to said coiler member for imparting rotation thereto includes shaft means rotatably mounted in substantially axially spaced relation from said stabilizing plate member, means rotatably connecting said coiler member to said shaft means in eccentric relation thereto, inboard wheel means mounted on said coiler member in fixed axial relation thereto, driven outboard wheel means positioned outwardly of said shaft means a sufficient distance to prevent interference of said outboard wheel means with the orbital movement of said coiler member about the axis of said stabilizing plate member and said shaft means, and an endless pliable element extending between and drivingly connecting said outboard wheel means to said inboard wheel means for rotating the same and imparting rotation to said coiler member.

8. A planetary coiler according to claim 7 wherein said wheel means have peripheral projecting teeth therearound, and wherein said endless pliable element is a flexible endless belt having teeth therealong meshing with said teeth of said wheel means.

9. A planetary coiler according to claim 2 wherein said means operably connected to said coiler member for imparting rotation thereto and moving the same in an orbital path includes shaft means rotatably mounted in substantially axial relation with respect to said stabilizing plate member, means rotatably connecting said coiler member to said shaft means in eccentric relation thereto, inboard first and second wheel means fixedly mounted on said shaft means and said coiler member, respectively in axial relation thereto, driven outboard first and second wheel means positioned outwardly of said shaft means sufficiently to avoid interference of said outboard wheel means with the orbital movement of said coiler member about the axis of said stabilizing plate member and said shaft means, and first and second endless pliable elements extending between and drivingly connecting the respective first and second driven outboard wheel means to the respective inboard first and second wheel means for rotating the same to move said coiler member in said orbital path while imparting rotation thereto about its own axis.

10. A planetary coiler according to claim 9 wherein each wheel means includes peripheral teeth extending therearound, and wherein said first and second pliable elements comprise endless flexible belts having teeth therealong meshing with the teeth of the respective first and second inboard and outboard wheel means.

11. A planetary coiler according to claim 9 wherein said means rotatably connecting said coiler member to said shaft means includes a laterally extending crank means carried by said shaft means and in which a portion of said coiler member is journaled, and further comprising feed roll means mounted on said crank means, means for transmitting rotation from said coiler member to said feed roll means for driving the same, and means defining respective strand guiding passages in said shaft means and said coiler means for guiding strand material through said shaft means to said feed roll means and for guiding the strand material from said feed roll means through said coiler member as the strand material is being fed by said feed roll means.

12. A planetary coiler according to claim 11 wherein said means for transmitting rotation to said feed roll means includes at least one adjacent pair of pulleys arranged in a drive train between said coiler member and said feed roll means, and an endless flexible belt entrained over and interconnecting said pair of pulleys for transmitting rotation from one to the other of said pulleys in said pair.

13. A planetary coiler for strand material comprising a circular stabilizing plate rotatable on a fixed axis and having an eccentric opening therein, a coiler member positioned for rotation within said eccentric opening, means operably connected to said coiler member for imparting rotation thereto and for moving the same in an orbital path of travel substantially concentric with the axis of said stabilizing plate, and means mounting said coiler member in driving relation to said stabilizing plate such as to impart rotation to the surrounding stabilizing plate upon orbital movement of said coiler members about said axis of said stabilizing plate, said means operably connected to said coiler member comprising shaft means mounted for rotation on a fixed axis coaxially of and spaced from said stabilizing plate, means rotatably connecting a portion of said coiler member to an adjacent end portion of said shaft means and in eccentric relation thereto, first and second wheel means fixedly mounted on said shaft means and said portion of said coiler member, respectively, driven outboard wheel means rotatably mounted outwardly of said shaft means so as to avoid interference of said outboard wheel means with the orbital movement of said coiler member about the axis of said shaft means, and endless pliable elements extending between and drivingly connecting said outboard wheel means to said first and second wheel means for driving said shaft means to move said coiler member in said orbital path of travel and for rotating said coiler member about its own rotational axis.

14. A planetary coiler according to claim 13 including means for guiding the strand material through the coiler comprising means defining a first angularly oriented passage through said shaft means and being open at that end of said shaft means remote from said stabilizing plate, and means defining a second angularly oriented passage through said coiler member in cooperating relation to said first passage and being open remote from said shaft means for defining an eccentrically positioned egress opening in said coiler member for egress of the strand material therethrough, and said passages being open at their proximal ends, and driven feed roll means positioned between the proximal ends of said first and second passages for feeding the strand material being guided successively through said first and second passages.

* * * * *

UNITED STATES PATENT AND TRADEMARK OFFICE

CERTIFICATE OF CORRECTION

PATENT NO. : 4,236,278

DATED : December 2, 1980

INVENTOR(S) : Donald L. Hoover

It is certified that error appears in the above-identified patent and that said Letters Patent are hereby corrected as shown below:

Column 2, Line 2, before the period "." insert --about said fixed axis--

Column 3, Line 47, "platform 20" should be --platform 10--

Column 6, Line 6, "pulley 3" should be --pulley e--

Column 7, Line 18, close parentheses before "A'"

Signed and Sealed this

*Third* Day of *March 1981*

[SEAL]

*Attest:*

RENE D. TEGTMEYER

*Attesting Officer*

*Acting Commissioner of Patents and Trademarks*